United States Patent [19]

Miller

[11] 4,050,284

[45] Sept. 27, 1977

[54] FASTENING MEMBER FOR ANCHORING A RAILWAY RAIL

[75] Inventor: David William Miller, Retford, England

[73] Assignee: Pandrol Limited, London, England

[21] Appl. No.: 682,792

[22] Filed: May 3, 1976

[30] Foreign Application Priority Data

May 7, 1975 United Kingdom ..... 19251/75

[51] Int. Cl.[2] ..... B21D 11/10

[52] U.S. Cl. ..... 72/384; 72/404; 72/385

[58] Field of Search ..... 72/384, 380, 381, 383, 72/386, 316, 385, 404; 29/16; 238/349

[56] References Cited

U.S. PATENT DOCUMENTS

| | | | |
|---|---|---|---|
| 1,899,280 | 2/1933 | Lidseen | 72/380 X |
| 2,116,670 | 5/1938 | Dawson | 72/384 X |
| 2,442,859 | 6/1948 | Ogden | 72/384 X |
| 3,004,716 | 10/1961 | Pande-Rolfsen | 238/349 |
| 3,297,253 | 1/1967 | Astley et al. | 238/349 |
| 3,658,246 | 4/1972 | Davies | 238/349 |

*Primary Examiner*—Lowell A. Larson
*Attorney, Agent, or Firm*—Haseltine, Lake & Waters

[57] ABSTRACT

A railway rail-fastening clip is made by bending a resilient rod at least 0.8 centimeter thick in a first bending operation to give it first to fifth portions in direct succession, proceeding from one end to the other, the first portion being a substantially straight leg, the second a reverse bend, the third being beside the first and the whole being such that in a particular position, with the first portion horizontal, in a plan view the third and fifth portions appear to be in opposite sides of the axis of the first portion. The whole of that part of the fifth portion which is between the lowest point in the fifth portion, when the bent rod is in said position, and the adjacent end of the rod is pressed in a second bending operation by a first shaping tool against a second shaping tool to make said end upturned. Preferably some of the fifth portion on the other side of said lowest point is also pressed by the first tool against the second, which is preferably formed with a recess into which the rod is pressed.

19 Claims, 13 Drawing Figures

Figure 7:
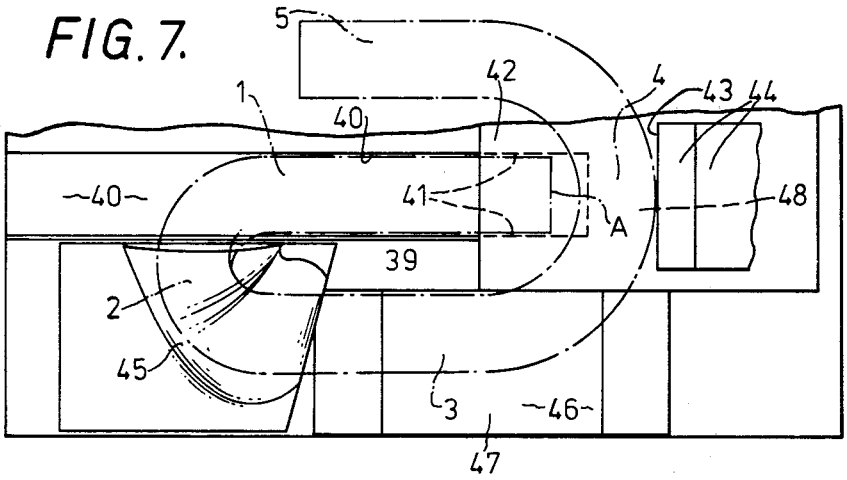

FIG. 1.
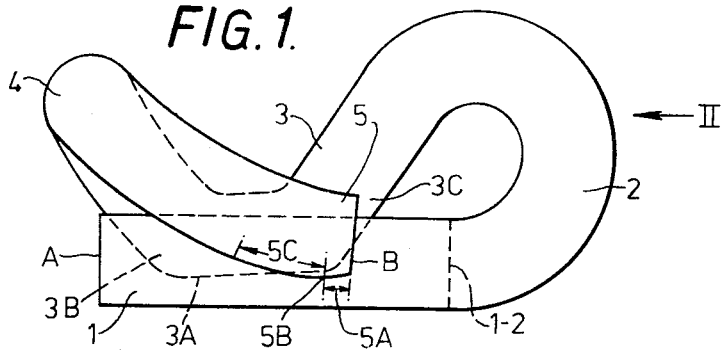
FIG. 2.
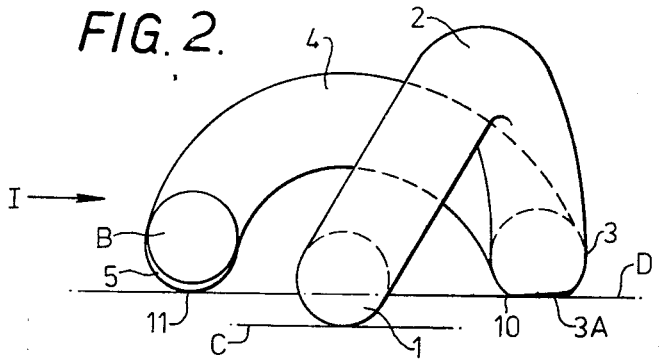
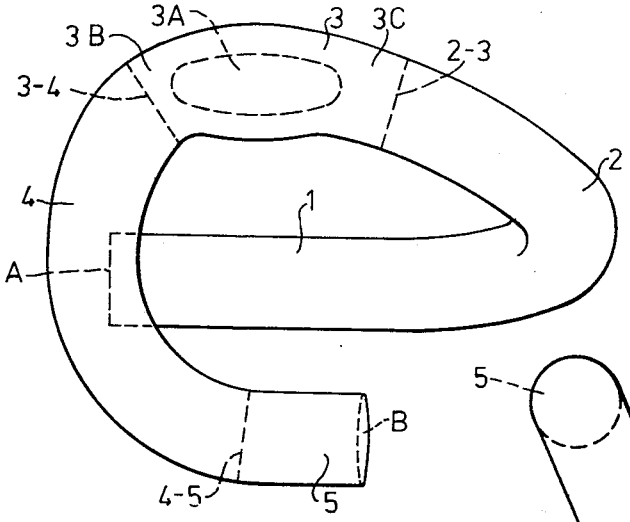
FIG. 3.
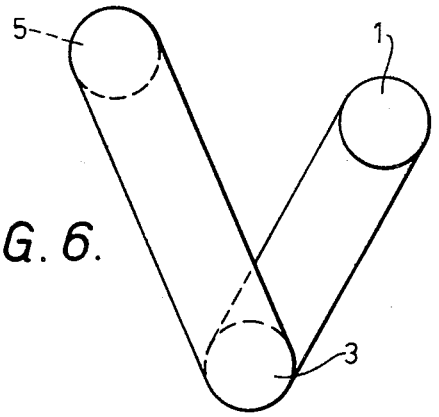
FIG. 6.

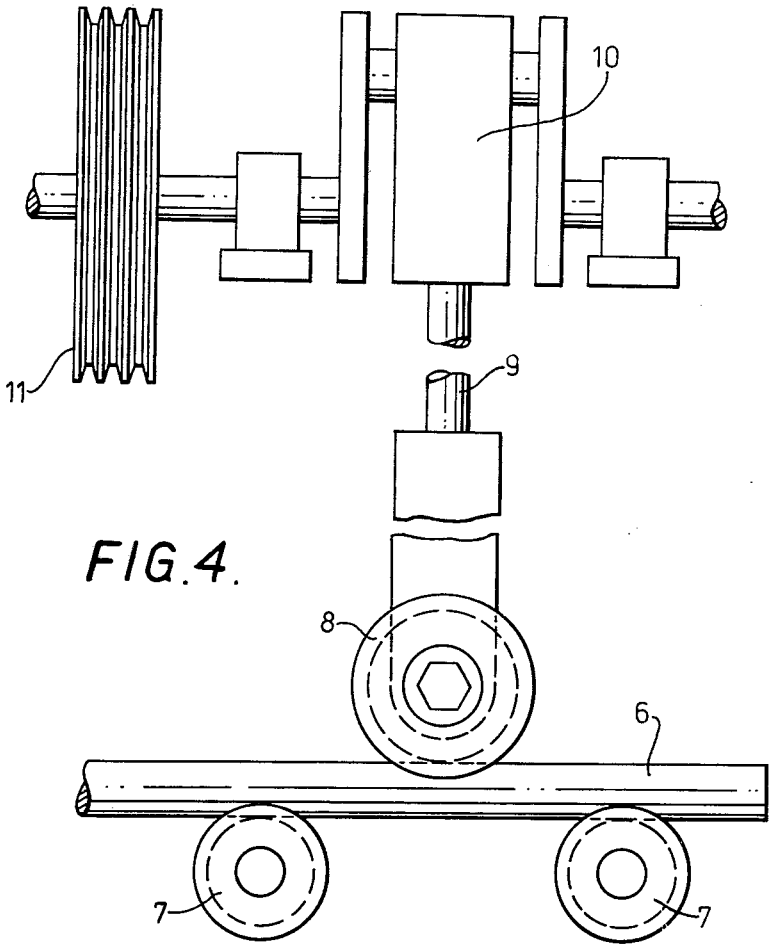
FIG. 4.
FIG. 5.
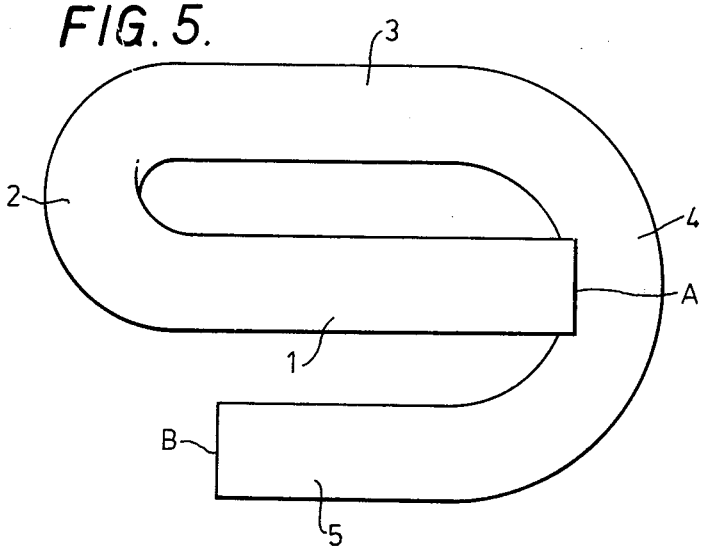

FASTENING MEMBER FOR ANCHORING A RAILWAY RAIL

According to a first aspect of the invention, a method of making a railway rail-fastening clip comprises subjecting a rod of resilient metal at least 0.8 cm thick to a first bending operation which results in the rod having, proceeding from one end of the rod to the other end, a first portion which is a substantially straight leg, a second portion which is a reverse bend, a third portion which is beside the first portion, then a fourth portion and then a fifth portion, the bent rod being such that when it is placed in a particular orientation with the first portion horizontal and the rod is viewed from above the third and fifth portions appear to be on opposite sides of the axis of the first portion, and then subjecting the bent rod to a second bending operation which results in said other end of the rod being up-turned and which comprises causing a first shaping tool to force into contact with a second shaping tool the whole of that part of the length of the rod which, when the finished clip is in a particular position, in which the lowermost points on both ends of the first portion lie in a horizontal plane, the lowermost points on the third and fifth portions lie in another horizontal plane and the fourth portion crosses and lies above the axis of the first portion, is between the lowermost point on the fifth portion and said other end of the rod.

According to a second aspect of the present invention, there is provided apparatus for effecting a second bending operation on a rod of resilient metal at least 0.8 centimeter thick which in a first bending operation has been bent so that it has, proceeding from one end of the rod to the other end, a first portion which is a substantially straight leg, a second portion which is a reverse bend, a third portion which is beside the first portion, then a fourth portion and then a fifth portion, the bent rod being such that when it is placed in a particular orientation with the first portion horizontal and the rod is viewed from above the third and fifth portions appear to be on opposite sides of the axis of the first portion, said second bending operation resulting in said other end of the rod being up-turned, and said apparatus comprising a first shaping tool, a second shaping tool and means for forcing one of the shaping tools towards the other, when part of the rod is between them, so that the whole of that part of the length of the rod which, when the finished clip is in a particular position, in which the lowermost points on both ends of the first portion lie in a horizontal plane, the lowermost points on the third and fifth portions lie in another horizontal plane and the fourth portion crosses and lies above the axis of the first portion, is between the lowermost point on the fifth portion and said other end of the rod is forced, by the first shaping tool, into contact with the second shaping tool, said apparatus further comprising support means for supporting the bent rod during the second bending operation and providing first, second, third and fourth support surfaces positioned for supporting the first, second, third and fourth portions, respectively, of the bent rod.

In the following description the clip is always described as though it were in said position.

The method and apparatus, described above, for making the clip are preferably such that some of that part of the length of the rod which, in the finished clip, is between the third portion and said lowermost point on the fifth portion is pressed by the first shaping tool into contact with the second shaping tool. Thus a continuous portion, preferably at least 2 centimeters in length, of the rod, possibly including part of the fourth portion, may be pressed against the second shaping tool, between the two ends of which portion lies the point which in the finished clip is the lowermost point on the fifth portion.

Preferably, the first shaping tool forces the relevant part of the rod into a recess in the second shaping tool and into contact with the bottom of the recess. The recess may be elongate with its depth decreasing, proceeding in both directions along the recess from a substantially central deepest part. The bottom of the recess may be flat over a length of at least 1 centimeter, preferably at least 2 centimeters, to produce a flat surface on the under side of the fifth portion of the clip. Alternatively, the depth of the recess may decrease smoothly, proceeding in both directions along the recess from the deepest part.

The method and apparatus for making the clip may be such that prior to the use of the first and second shaping tools the rod is bent in a first bending operation so that its plan view is similar to that of the finished clip. For example, after the first bending operation the rod, if viewed in one way, may look rather like a letter *e* or a mirror image of a letter *e* and, if viewed in another way, may look rather like a letter *v*. Alternatively, in a plan view of the finished clip the fifth portion and part of the fourth portion may appear to be substantially straight and substantially perpendicular to the first portion and the rod may have substantially the same plan view after the first bending operation and before the first and second shaping tools are used in a second bending operation.

The method and apparatus may be such that after the first bending operation a third shaping tool presses into contact with a fourth shaping tool a part of the rod which, in the finished clip, is the lowest part of the third portion. The first and third shaping tools may be integral with one another or fixed together and if desired they may be fixed to or integral with a holding part which engages the part of the rod corresponding to the first portion of the clip to hold the rod still. The fourth shaping tool may have a flat surface against which the rod is pressed to produce a flat surface on the under side of the third portion of the clip.

The second shaping tool, and/or the fourth shaping tool if it is present, may stand on a wedge member which can be moved, without the shaping tool moving with it, along a surface inclined by a small angle to the horizontal to cause the shaping tool to move vertically to adjust its position prior to its being fixed with respect to the wedge member and used.

Figure 8:
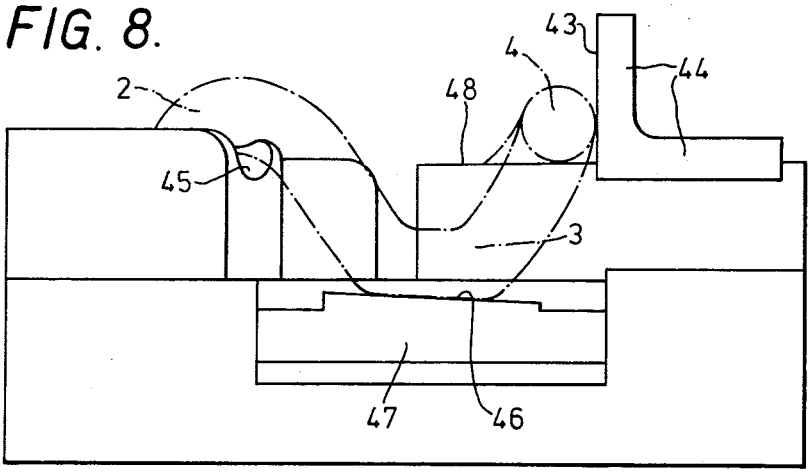
Figure 9:
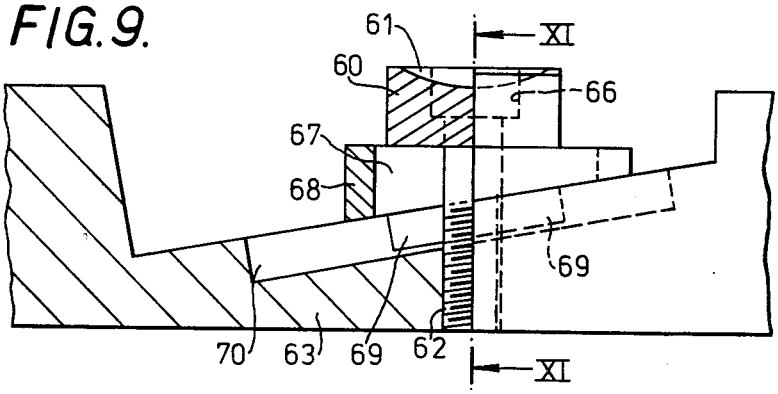
Figure 10:
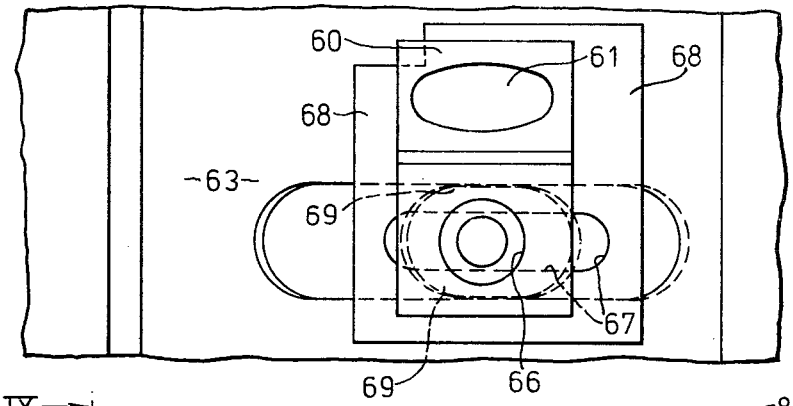
Figure 10:
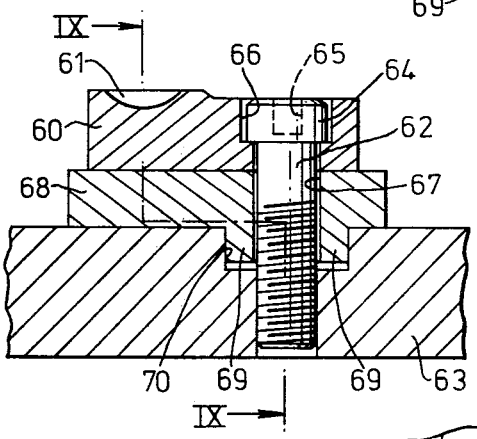
Figure 11:
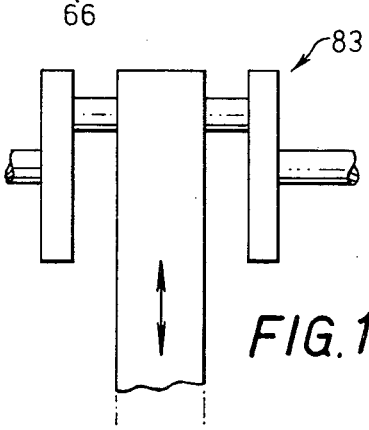
Figure 13:
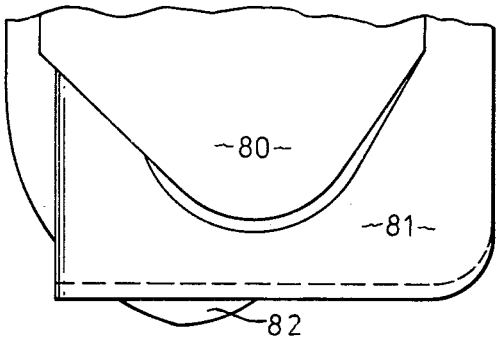
Figure 12:
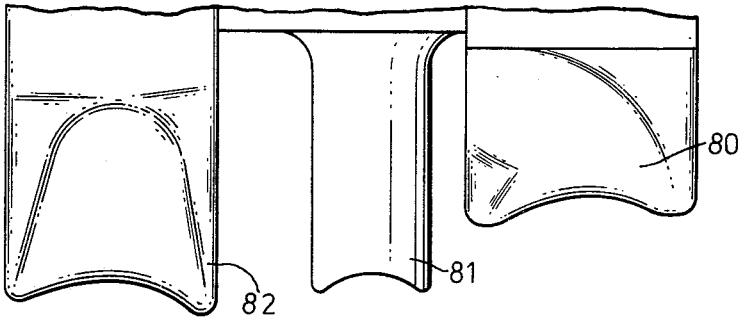

An example in accordance with the invention is described below with reference to the accompanying drawings, in which:

FIG. 1 shows a side view of a railway rail-fastening clip, taken in the direction of the arrow I in FIG. 2, FIG. 2 shows an end view of the clip, taken in the direction of the arrow II in FIG. 1, FIG. 3 shows a plan view of the clip, FIG. 4 shows diagrammatically part of a first bending apparatus, FIGS. 5 and 6 show two views of the shape of a rod after being bent by the first bending apparatus, FIG. 7 shows a plan view of part of a second bending apparatus for making the clip of FIGS. 1 to 3 from a bent rod according to FIGS. 5 and 6, which is here shown in dash-dot lines, FIG. 8 shows a side view of the same part and part of the finished clip, FIG. 9 shows a side view, partly in section taken along the line IX of FIG. 11, of a second part of the second bending apparatus, FIG. 10 shows a plan view of the same, FIG. 11 shows another side view of the same, in section taken along the line XI in FIG. 9, FIGS. 12 and 13 show two side views of another part of the second bending apparatus.

The rail-fastening clip shown in FIGS. 1 to 3 has been made by bending a rod of resilient steel of circular cross-section and a diameter at least 0.8 centimeter so that it has, progressing from one end A to the other end B, a first portion 1 which is a straight leg (although it could be slightly bowed, for example arched), a second portion 2 which is a reverse bend, a third portion 3 which is beside the first portion 1 and extends from the portion 2 in the general direction towards the end A, a fourth portion 4 and a fifth portion 5. The places where these portions meet are marked by the lines 1-2, 2-3, 3-4 and 4-5, although it is a matter of opinion exactly where these lines should be. The clip is shown in a particular orientation with a horizontal plane D containing the lowermost points 10 and 11 on the third and fifth portions 3 and 5 and a lower horizontal plane C containing the lowermost points on the opposite ends of the first portion 1 (and the lowermost points all along the first portion 1 in this case because the first portion 1 is straight). In this orientation the fourth portion 4 crosses and lies above a part of the axis of the first portion 1. In the illustrated case the fourth portion constitutes the greater part of another reverse bend. When the clip is viewed from above the third and fifth portions 3 and 5 appear to be on opposite sides of the axis of the first portion 1. The part 5A of the fifth portion curves upwardly from the lowest point 5B of the fifth portion to the end B and the part 5C curves downwardly from the junction between the fourth and fifth portions to the point 5B. The third portion has a flat surface 3A on its lower side and at its lowest point and parts 3B and 3C curving upwardly from it so that the middle part of the third portion is lower than its ends.

Examples of railway rail-and-fastening assemblies in which the clip according to FIGS. 1 to 3 can be used are disclosed in U.S. Pat. Nos. 3,004,716, 3,297,253 and 3,658,246.

FIG. 4 diagrammatically illustrates part of a first bending apparatus which produces the reverse bends 2 and 4. The steel rod 6, whilst red hot, is laid in grooves in two rollers 7 and a grooved former 8 is pushed downwardly between them by a rod 9 coupled to a crank 10 driven by a belt wheel 11. This makes a U-bend in a first plane. Then, using the same bending means or a similar one, a second reverse bend is made in the same way in another plane inclined to the first by about 65° (the angle could be 25°, 95° or any angle between the two, depending on the shape of the clip to be produced). Then in one orientation of the bent rod it appears from one viewing point rather like a mirror image of a letter *e*, as shown in FIG. 5, (it could instead look rather like a letter *e*) and in another orientation and from another viewing point it looks rather like a letter *v*, as shown in FIG. 6.

While still red hot, the rod with the shape shown in FIGS. 5 and 6 is transferred to a second bending apparatus shown in FIGS. 7 to 13. This includes a member 39 having an insert formed with a groove 40 along which the first portion 1 of the rod is slid until the end A of it enters a hole 41 in a block 42 and the movement of the rod is arrested by the portion 4 abutting a face 43 of a member 44 of L-shaped cross-section the position of which can be adjusted by means not shown. At that stage, illustrated in FIG. 7, the portion 1 of the rod is supported by the bottom of the groove 40, the portion 2 is supported by the bottom of a groove 45 (it could instead rest on a horizontal spigot), the portion 3 is above and spaced from a flat but inclined surface 46 on a block 47, the portion 4 is above and spaced from a surface 48 on the block 42 and the portion 5 is above an arrangement which is shown in FIGS. 9 to 11. FIG. 8 shows the finished clip.

FIGS. 9 to 11 shows a substantially oblong block 60 formed with a recess 61 in its upper surface, the mouth of the recess being substantially elliptical as shown in FIG. 10 and the depth of the recess decreasing smoothly, proceeding from the centre in either direction along the major axis (which is parallel to the groove 40) and in either direction along the minor axis. The fifth portion 5 of the bent rod is to extend along the length of, and to be pressed into, this recess so that the point which is to be the lowermost point 5B in the finished clip is pressed against the bottom of the recess at about its centre and parts of the clip over at least half a centimeter, preferably at least 1 centimeter, adjacent the point 5B, on the side of the point 5B nearer the third portion, and the whole of that part of the rod which is on the other side of the point 5B, are also pressed against the bottom of the recess. The block 60 is secured by a screw 62 to a block 63, the screw having a head 64 formed with an opening 65 of hexagonal cross-section and lying in a recess 66 in the block 60, the screw head not being shown in FIG. 9 and none of the screw being shown in FIG. 10. The screw 62 passes through an elongate hole 67 which passes right through a wedge member 68 and it also passes between two elongate projections 69 extending downwardly from the wedge member. These projections lie in an elongate recess 70 in the block 63. Thus by slackening the screw 62 and moving the wedge member 68 to left or right (FIGS. 9 and 10) before tightening the screw again, the block 60 can be raised or lowered. It is desirable to have a set of blocks 60 with the recesses 61 of different shapes and/or position. The block 47 could likewise, in addition to or instead of the block 60, be provided with an arrangement of an adjustable wedge member under it to permit it to be raised and lowered.

FIGS. 12 and 13 show an upper shaping arrangement comprising three separate and replaceable shaping tools 80, 81 and 82, each formed with a groove in its lower surface, the three parts being fixed together and alternately moved downwardly and upwardly by a crank 83. On the right-hand side of the tool 80, considering FIG. 12, there may be a finger, not shown, which depends downwardly below the tool 80, and moves with the tools 80 to 82 and prevents the portion 5 of the bent rod moving too far to the right (considering FIG. 12) away from the portion 1. In an alternative version of the tool 80, there is no groove in it and the bottom of it, in a view corresponding to FIG. 12, appears as a straight horizontal line, the view shown in FIG. 13 being unchanged.

When a rod shaped as shown in FIGS. 5 and 6 is laid on the bending apparatus of FIGS. 7 to 11 and the upper shaping arrangement descends, the parts 80 and 82 touch the portions 5 and 3 respectively and press the portion 5 into the recess 61 and the portion 3 against the flat surface 46 to give it the flat surface 3A, the portion 81 then engaging the portion 1 of the clip. More than half a centimeter of the rod on each side of the lowest point 5B of the fifth portion makes contact with the bottom of the recess 61 and in this way the fifth portion 5 is given its desired final shape with accuracy.

I claim:

1. A method of making a railway rail-fastening clip comprising subjecting a rod of resilient metal at least 0.8 centimeter thick to a first bending operation which results in the rod having, proceeding from one end of the rod to the other end, a first portion which is a substantially straight leg, a second portion which is a reverse bend, a third portion which is beside the first portion, then a fourth portion and then a fifth portion, the bent rod being such that when it is placed in a particular orientation with the first portion horizontal and the rod is viewed from above the third and fifth portions appear to be on opposite sides of the axis of the first portion, and then subjecting the bent rod to a second bending operation which results in said other end of the rod being up-turned and which comprises causing a first shaping tool to force into contact with a second shaping tool the whole of that part of the length of the rod which, when the finished clip is in a particular position, in which the lowermost points on both ends of the first portion lie in a horizontal plane, the lowermost points on the third and fifth portions lie in another horizontal plane and the fourth portion crosses and lies above the axis of the first portion, is between the lowermost point on the fifth portion and said other end of the rod.

2. A method according to claim 1 in which in the second bending some of that part of the length of the rod which, in the finished clip, is between the third portion and said lowermost point on the fifth portion is pressed by the first shaping tool into contact with the second shaping tool.

3. A method according to claim 2 in which in the second bending operation a continuous portion, at least 2 centimeters in length, of the rod is pressed against the second shaping tool, between the two ends of which portion lies the point which in the finished clip is the lowermost point of the fifth portion.

4. A method according to claim 1 in which in the second bending operation the first shaping tool forces said part of the rod into a recess in the second shaping tool and into contact with the bottom of the recess.

5. A method according to claim 4 in which the recess is elongate with its depth decreasing, proceeding in both directions along the recess from a substantially central deepest part.

6. A method according to claim 1 in which, after the first bending operation, the rod, if viewed in one way, looks rather like a mirror image of a letter *e* and, if viewed in another way, looks rather like a letter *v*.

7. A method according to claim 1 in which, after the first bending operation, a third shaping tool presses into contact with a fourth shaping tool a part of the rod which, in the finished clip, is the lowest part of the third portion.

8. A method according to claim 7 in which the first and third shaping tools move with one another.

9. A method according to claim 8 in which the first and third shaping tools move with a holding part which engages the part of the rod corresponding to the first portion of the clip to hold the rod still.

10. A method according to claim 7 in which the fourth shaping tool has a flat surface against which the rod is pressed to produce a flat surface on the under side of the third portion of the clip.

11. A method according to claim 1 in which the second shaping tool stands on a wedge member which can be moved, without the shaping tool moving with it, along a surface inclined by a small angle to the horizontal to cause the shaping tool to move vertically to adjust its position prior to its being fixed with respect to the wedge member and used.

12. A method according to claim 7 in which the fourth shaping tool stands on a wedge member which can be moved, without the shaping tool moving with it, along a surface inclined by a small angle to the horizontal to cause the shaping tool to move vertically to adjust its position prior to its being fixed with respect to the wedge member and used.

13. Apparatus for effecting a second bending operation on a rod of resilient metal at least 0.8 centimeter thick which in a first bending operation has been bent so that it has, proceeding from one end of the rod to the other end, a first portion which is a substantially straight leg, a second portion which is a reverse bend, a third portion which is beside the first portion, then a fourth portion and then a fifth portion, the bent rod being such that when it is placed in a particular orientation with the first portion horizontal and the rod is viewed from above the third and fifth portions appear to be on opposite sides of the axis of the first portion, said second bending operation resulting in said other end of the rod being up-turned, and said apparatus comprising a first shaping tool, a second shaping tool and means for forcing one of the shaping tools towards the other, when part of the rod is between them, so that the whole of that part of the length of the rod which, when the finished clip is in a particular position, in which the lowermost points on both ends of the first portion lie in a horizontal plane, the lowermost points on the third and fifth portions lie in another horizontal plane and the fourth portion crosses and lies above the axis of the first portion, is between the lowermost point on the fifth portion and said other end of the rod is forced, by the first shaping tool, into contact with the second shaping tool, said apparatus further comprising support means for supporting the bent rod during the second bending operation and providing first, second, third and fourth support surfaces positioned for supporting the first, second, third and fourth portions, respectively, of the bent rod.

14. Apparatus according to claim 13 and including a wedge member upon which the second shaping tool stands and which can be moved, without the shaping tool moving with it, along a surface inclined by a small angle to the horizontal to cause the shaping tool to move vertically to adjust its position prior to its being fixed with respect to the wedge member and used.

15. Apparatus according to claim 13 comprising third and fourth shaping tools of which the third shaping tool presses into contact with said third support surface on the fourth shaping tool a part of the rod which, in the finished clip, is the lowest part of the third portion and further comprising a wedge member upon which the fourth shaping tool stands and which can be moved, without the shaping tool moving with it, along a surface inclined by a small angle to the horizontal to cause the shaping tool to move vertically to adjust its position prior to its being fixed with respect to the wedge member and used.

16. Apparatus according to claim 14 in which the wedge member has an elongate hole through it, through which passes a screw, and has two downwardly-extending projections between which the screw passes and which run in an elongate recess in a body having said surface inclined by a small angle to the horizontal, the screw fixing together the second shaping tool and said body.

17. Apparatus according to claim 13 having a groove which affords said first support surface and along which the first portion of the rod can slide unitl it is stopped by the fourth portion hitting a stop projection.

18. Apparatus according to claim 13 having two forming tools and a holding member which descend simultaneously to engage the parts of the rod corresponding to the third, fifth and first portions of the clip.

19. Apparatus according to claim 13 and such that some of that part of the length of the rod which, in the finished clip, is between the third portion and said lowermost point on the fifth portion is pressed by the first shaping tool into contact with the second shaping tool.

* * * * *